US008528769B1

(12) United States Patent
McKenna

(10) Patent No.: US 8,528,769 B1
(45) Date of Patent: Sep. 10, 2013

(54) LIFTER APPARATUS AND METHOD

(76) Inventor: Daniel J. McKenna, Pensacola, FL (US)

( * ) Notice: Subject to any disclaimer, the term of this patent is extended or adjusted under 35 U.S.C. 154(b) by 345 days.

(21) Appl. No.: 11/895,815

(22) Filed: Aug. 28, 2007

(51) Int. Cl.

| | |
|---|---|
| ***B65D 53/00*** | (2006.01) |
| ***B65D 45/00*** | (2006.01) |
| ***B65D 17/50*** | (2006.01) |
| ***B65D 41/02*** | (2006.01) |
| ***B65D 43/26*** | (2006.01) |
| ***B65D 43/14*** | (2006.01) |
| ***B65D 51/04*** | (2006.01) |

(52) U.S. Cl.
USPC ..... 220/263; 220/236; 220/247; 220/260; 220/262; 220/264; 220/845; 220/849

(58) Field of Classification Search
USPC ..... 220/236, 260, 262, 264, 247, 263, 220/845, 849
See application file for complete search history.

(56) References Cited

U.S. PATENT DOCUMENTS

| | | | | |
|---|---|---|---|---|
| 4,284,203 | A * | 8/1981 | Mize | 220/228 |
| 4,518,095 | A * | 5/1985 | Engwert | 220/260 |
| 4,680,891 | A * | 7/1987 | Perkins | 49/280 |
| 4,883,189 | A * | 11/1989 | Lobbert | 220/260 |
| 5,992,680 | A * | 11/1999 | Smith | 220/812 |

* cited by examiner

*Primary Examiner* — Anthony Stashick
*Assistant Examiner* — Andrew T Kirsch
(74) *Attorney, Agent, or Firm* — J. Nevin Shaffer, Jr.

(57) ABSTRACT

A lift apparatus and method include, in a structure with a lid, a lift arm connected with the lid and with a lift pivot. A movement arm with a flexible connection with a first end and a second end is provided where the first end of the flexible connection is connected with the lift arm and where the second end of the flexible connection is connected with the movement arm. And an actuator is connected with the movement arm for selected movement of the arm and thus the lid.

9 Claims, 4 Drawing Sheets

LIFTER APPARATUS AND METHOD

FIELD OF THE INVENTION

This invention relates to a lift apparatus and method for use with structures with a lid. In particular, in accordance with one embodiment, a lift apparatus includes a lift arm connected with the lid and with a lift pivot. A movement arm with a flexible connection with a first end and a second end is provided where the first end of the flexible connection is connected with the lift arm and where the second end of the flexible connection is connected with the movement arm. And an actuator is connected with the movement arm for selected movement of the movement arm and thus the lid.

BACKGROUND OF THE INVENTION

Many facilities rely on a trash receptacle called a "dumpster" in which to place the trash generated at the facility. A typical dumpster is a metal or plastic box of multiple cubic yardage in size. The dumpster usually has one or more lids commonly mounted on its top and some units have sliding doors to access the interior of the dumpster at a lower level. This lower level access allows trash to be placed into the dumpster without raising the lid(s). Once a dumpster with sliding doors is filled to a level approximately even with the bottom of the sliding doors, however, the trash then has to be placed into the dumpster by raising the lids first. This basic set up of a dumpster has been in use for many years and works but has always presented the problem of having to raise the lid(s) at some point which is not easy to do.

To minimize the number of times that a dumpster has to be emptied, the dumpsters are designed to be as large as needed to hold the amount of trash regularly placed in them between scheduled pick ups. Standard dumpster size ranges up to twelve cubic yards. To minimize space taken up by these large dumpsters, they are built tall. Dumpster height can go up to eighty inches high from the ground to the lid. Further, lid length varies up to sixty inches. The combination of lid length, size, weight, and height above the ground make it a significant problem in raising one or more lids high enough to place trash in the dumpster.

To make it easier to place trash into the dumpster and to raise the lid(s), some dumpsters are made with sloped tops. This lowers the front height of the lids and allows a person placing trash into the dumpster to possibly lift the lid with one hand and place the trash in with the other hand. If the weight or size of the trash requires both hands, the person placing the trash in the dumpster must first fully open the lids before placing the trash into the dumpster. It is a significant task to raise one or more lids to their fully open position and close them again. That task gets multiplied many times if the lids are filled/covered with water or snow and weigh much more than their normal weight or the wind is blowing and is applying force to the large lid surface area.

The task of raising a lid fully open is currently usually done one of two ways. The first way is by hand or by use of a long pole. The second way is by a person climbing on the side of the dumpster and lifting the lid fully open. The second way is unsafe and dumpster manufacturers install decals warning users not to climb on the dumpster for safety reasons.

Thus, there is a need in the art for an apparatus and method to safely, easily and economically raise a lid, in particular a lid such as is found in trash receptacles called dumpsters. It, therefore, is an object of the invention to provide a lift for use with lids that is robust and reliable enough to operate effectively with rough use, that can be an economical add on to existing dumpsters or installed as original equipment, that is easy and safe for one person to use and which enables a person to use both hands to position the trash into the dumpster. Further, there is a need that when the trash has been placed into the dumpster, the lid(s) can then be easily closed back to their normal position. Thus, this device has multiple requirements. The device must be easy to use. It must be able to lift heavily loaded snow or water covered lids. Importantly, it must not impede dumpster emptying by the waste hauling company.

SUMMARY OF THE INVENTION

Accordingly, in a structure with a lid, a lift apparatus, according to one embodiment of the invention, includes a lift arm connected with the lid and with a lift pivot. A movement arm with a flexible connection, with a first end and a second end, is provided in which the first end of the flexible connection is connected with the lift arm and where the second end of the flexible connection is connected with the movement arm. An actuator is connected with the movement arm for selected movement of the movement arm and thus the lid.

As used herein, the term "lid" includes all movable coverings usually and normally associated with the term and in the trash receptacle field as known in the art. Such lids may be made of any material such as metal, wood and/or plastic. Plastic lids are light weight but flexible and susceptible to warping or bending if not properly supported as disclosed and described more fully herein.

Further, as used herein, the term "actuator" refers preferably to a hydraulic cylinder powered by either manual or electric pumps. Obviously, any appropriate actuator now known or hereafter developed is included within the common meaning of the term. That is, the term includes, for example only, a winch assembly powered by a hand crank or electric motor, a gear rack powered by a hand crank or electric motor and/or a linear actuator powered by hand or motor.

Still further, the term "flexible connection" is used herein with its common meaning and as known in the art of flexible mechanical connections such as chain and wire. Obviously any other connection that is flexible is included herein as well as for example only and not limitation, multiple pivotable links and slippery mechanical joints including pins sliding in slots.

In another aspect of the invention a limiter is connected with the lift apparatus such that movement of the lift arm beyond a predetermined amount is limited. In another aspect of the invention, a lid connector is connected with the lid and the lift arm and the lid connector includes a number of separate connections with the lid. In a further aspect, the lid includes a first side and a second side and the lid connector is connected to the first side and at least one lid reinforcement is connected to the second side and through the lid to the lid connector. In another aspect, the lid connector is connected with the lift arm at approximately a right angle. In another aspect, the lift arm and the lid reinforcements can be built into the lid itself.

According to another aspect, the flexible connection is selected from a group including: chain, wire, multiple pivotable links and slippery mechanical joints including pins in slots. In another aspect, the actuator is powered by a hydraulic pump. In another aspect, the hydraulic pump is selected from a group including: manual pumps and electrical pumps.

In a further aspect, the limiter includes a limiter return. In another aspect, the limiter return is automatic. In another aspect, the limiter return is selected from a group including: gas and spring operated limiter returns.

According to another embodiment of the invention, in a structure with a lid, a lift apparatus includes a lift arm connected with the lid and with a lift pivot. A lid connector is connected with the lid and the lift arm and the lid connector includes more than one connection with the lid. A movement arm, with a flexible connection with a first end and a second end, is provided and the first end of the flexible connection is connected with the lift arm and the second end of the flexible connection is connected with the movement arm. An actuator is connected with the movement arm and a limiter is connected with the lift pivot such that movement of the lift arm beyond a predetermined amount is limited.

According to a further aspect, the lid includes a first side and a second side and the lid connector is connected to the first side and at least one lid reinforcement is connected to the second side and through the lid to the lid connector. In another aspect, the lid connector is connected with the lift arm at approximately a right angle.

In a further aspect, the flexible connection is selected from a group including: chain, wire, multiple pivotable links and slippery mechanical joints including pins in slots. In another aspect, the actuator is powered by a hydraulic pump. In another aspect, the hydraulic pump is selected from a group including: manual pumps and electrical pumps.

In another aspect, the limiter includes a limiter return. In a further aspect, the limiter return is automatic.

According to another embodiment of the invention, in a structure with a lid, a lid lift method includes the steps of providing a lift arm connected with the lid and with a lift pivot, a movement arm with a flexible connection, with a first end and a second end, where the first end of the flexible connection is connected with the lift arm and where the second end of the flexible connection is connected with the movement arm, and an actuator is connected with the movement arm and operating the actuator so as to move the lift arm and move the lid.

In another aspect of the method, the actuator is powered by a manual hydraulic pump and operation of the hydraulic pump moves the lift arm and moves the lid.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
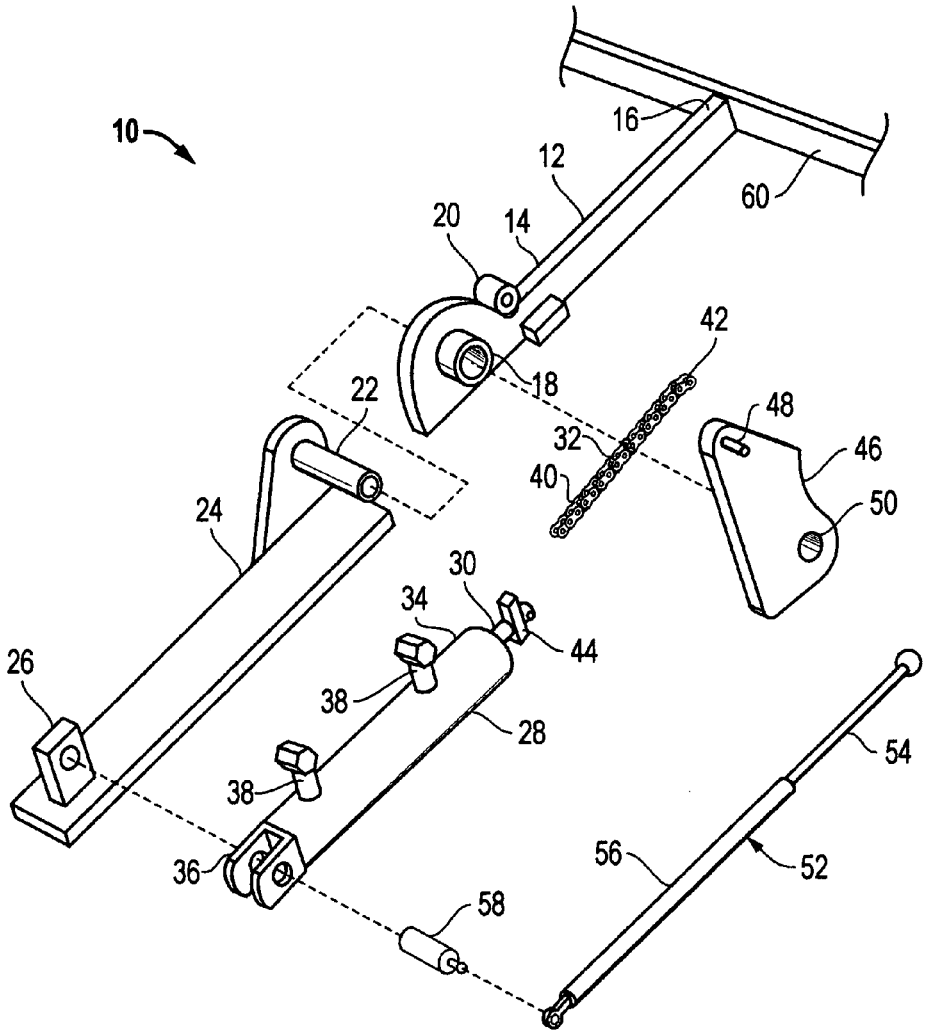
FIG. 1 is an exploded view of the lift apparatus according to one embodiment of the invention.

The preferred embodiment of the present invention is illustrated by way of example in FIGS. 1-4. With specific reference to FIG. 1, lift apparatus 10, according to one embodiment of the invention, includes a lift arm 12. As illustrated in the exploded view of FIG. 1, lift arm 12 includes a first end 14 and a second end 16. First end 14 of lift arm 12 includes hinge bearing 18 and attachment point 20. Hinge bearing 18 is conformed to connect with and rotate about lift pivot 22. Lift pivot 22 is connected with mounting plate 24. Mounting plate 24 also includes rear mount 26.

Actuator 28 includes movement arm 30 and flexible connection 32 connected at the front 34 of actuator 28. Rear connector 36 on actuator 28 is conformed to connect with rear mount 26 on mounting plate 24. FIG. 1 also illustrates an aspect of the invention in which actuator 28 includes hydraulic fluid ports 38 as will be described more fully hereafter.

Flexible connection 32 includes a first end 40 and a second end 42 in which the first end 40 is connected with the movement arm 30 at movement arm connection 44. Second end 42 of flexible connection 32 is conformed to connect with attachment point 20 of lift arm 12.

Still referring to FIG. 1, limiter 46 includes return connection 48 and limiter bearing 50 conformed to connect with lift pivot 22. Further, according to one aspect of the invention, limiter return 52 includes extendable shaft 54 and receiver 56 within which extendable shaft 54 is moveably retained. Extendable shaft 54 is connected with limiter 46 at return connection 48. Receiver 56 is connected with actuator 28 by receiver connector 58.

FIG. 1 also illustrates lid connector 60 connected at approximately a right angle to lift arm 12 at second end 16 as will be more fully described with reference to FIG. 4.

Figure 2:
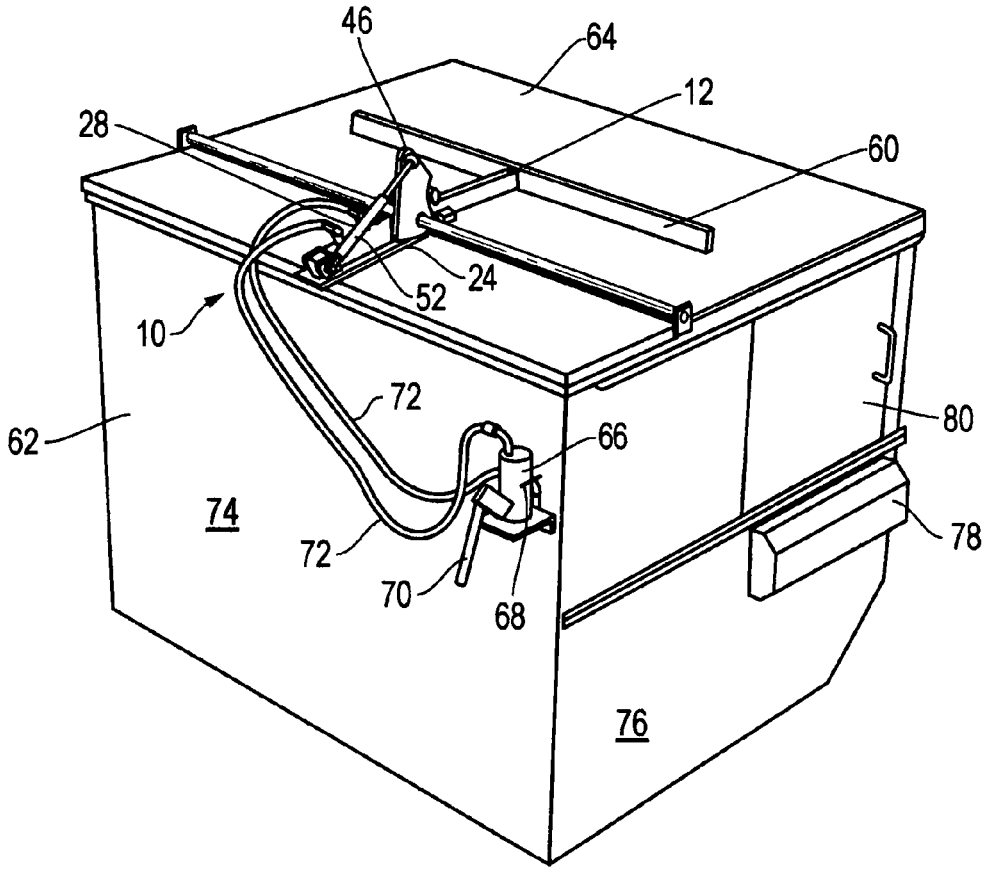
FIG. 2 is a perspective view of the lift apparatus of FIG. 1 connected with a dumpster with the lid down.
Figure 3:
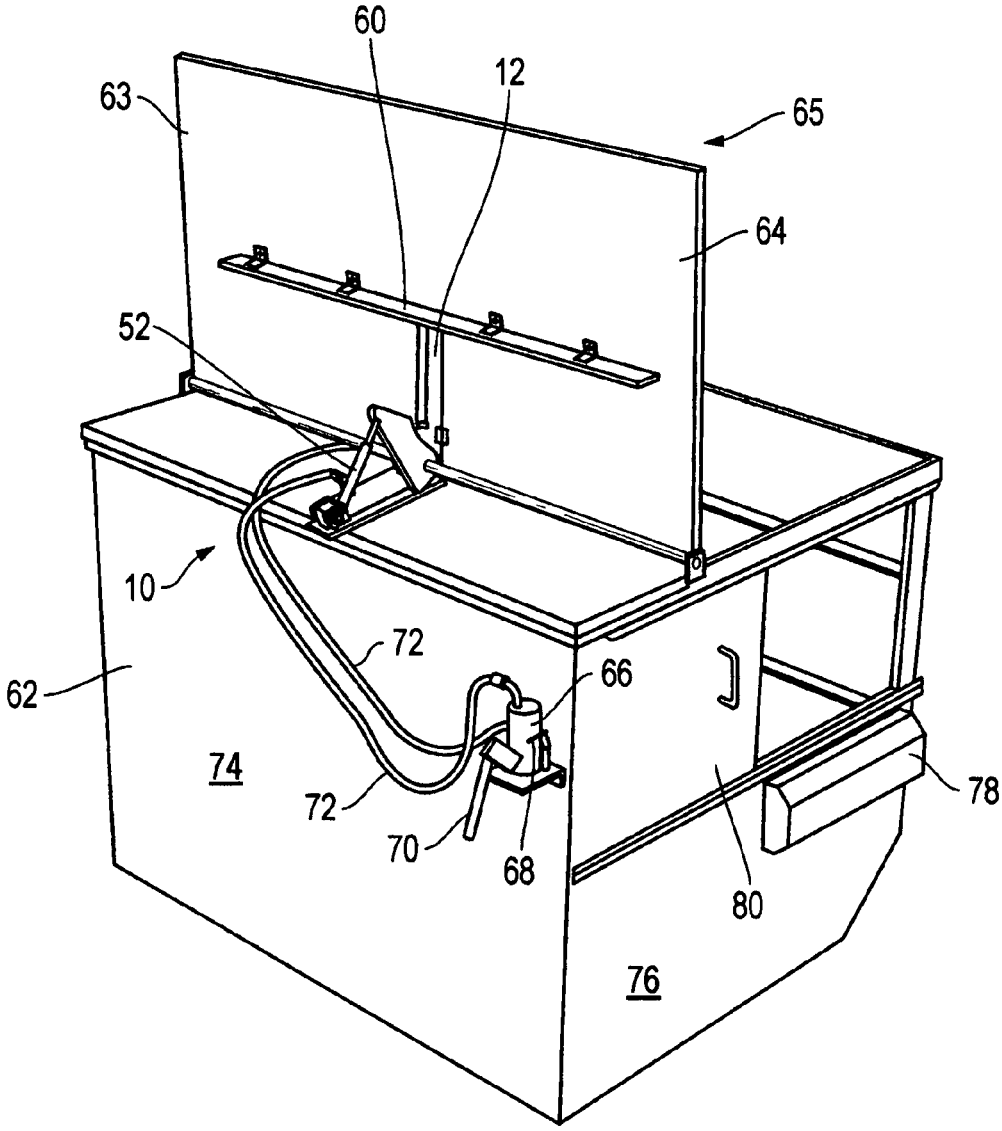
FIG. 3 is a perspective view of the lift apparatus of FIG. 1 connected with a dumpster with the lid in the raised position.

Referring now to FIGS. 2 and 3, the lift apparatus 10 according to one embodiment is shown connected with a structure, dumpster 62, with a lid 64. Lid 64 includes first side 63 and second side 65. Also shown is pump 66. Pump 66 may be any type of pump now known or hereafter developed including, for example only and not by limitation, a manual or electric hydraulic pump. As illustrated, pump 66 is a manually operated hydraulic pump including valve lever 68, and hydraulic lines 72. Hydraulic lines 72 are connected with hydraulic ports 38 on actuator 28. Preferably, pump 66 is attached to dumpster 62 on the back 74 and not on the side 76. Dumpster 62 includes dump truck fork receivers 78 and any item attached to the side(s) 76 of dumpster 62 is going to be damaged, sooner or later, when the dump truck (not shown) picks up the dumpster 62 to empty it.

FIG. 2 shows dumpster side door 80 in the closed position and FIG. 3 shows dumpster side door 80 in the open position. Likewise, FIG. 2 shows lid 64 in the closed or lowered position and FIG. 3 shows lid 64 in the open or raised position. In the open position extendable shaft 54 of limiter return 52 is in an extended position. As lift apparatus 10 is operated to lift lid 64, extendable shaft 54 is compressed within receiver 56 as shown in FIG. 3. Receiver 56 may also include a spring or a gas medium that resists extendable shaft 54 and, once the pressure raising lid 64 is released, as will be described more fully hereafter, extendable shaft 54 is forced out of receiver 56, as shown in FIG. 2, thereby causing lid 64 to move toward the closed position.

Figure 4:
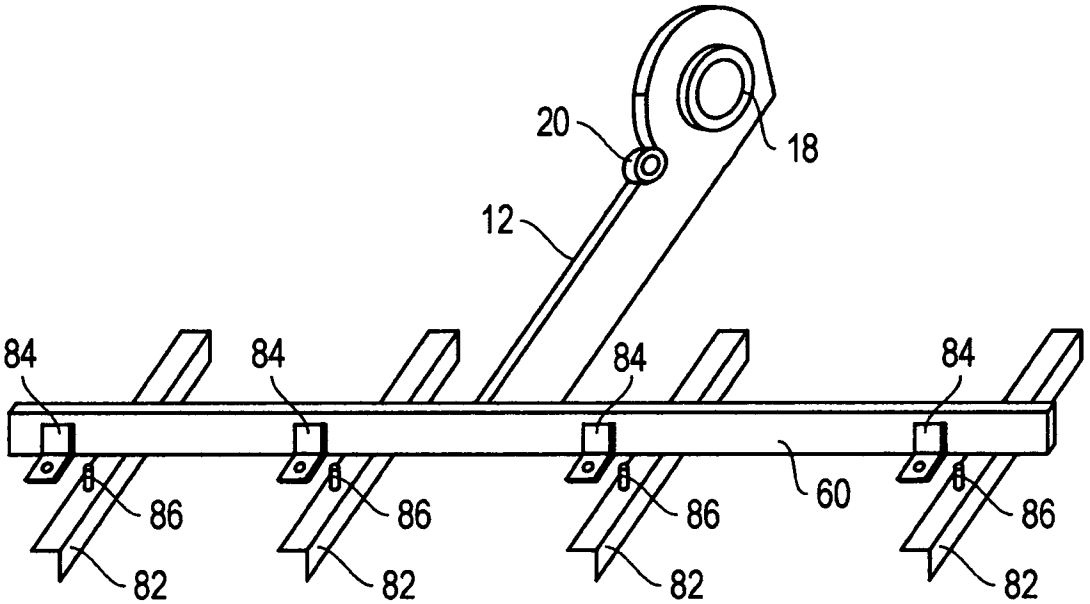
FIG. 4 is a perspective view of the lift arm connected with the lid connector and lid reinforcers according to an embodiment of the invention.

Referring now to FIG. 4, an exploded perspective view of the lift arm 12 and lid connector 60 is shown. According to one embodiment of the invention, lid connector 60 is connected with lift arm 12 at approximately right angles. This spreads the lifting force across a greater area of lid 64 (not shown in FIG. 4). Further, in one aspect, lid connector 60 is connected with lid 64 by means of lid reinforcements 82. Preferably, a number of lid reinforcements 82 are located on the second side 65 of lid 64 and lid connector 60 is located on the first side 63 of lid 64. Attachments 84 on lid connector 60 are connected with attachers 86 on lid reinforcements 82. Attachments 84 and attachers 86 may be nut and bolt combinations, for example, or any method and means now known or hereafter developed. In a preferred embodiment, lid 64 is captured between lid connector 60 on one side of lid 64, first side 63, and lid reinforcers 82 on another side of lid 64, second side 65, for example. Again, this combination spreads the lifting force over a wide area of the lid 64 and enables a user to controllably manipulate the heavy flexible lid 64. Obviously, the lift arm 12, lid connector 60, lid reinforcements 82 may all be built into lid 64 as opposed to being added onto lid 64.

In operation, a user first moves valve lever 68 on pump 66 to the "lift" position. Then the users operates the manual pump handle 70 on pump 66 to supply oil and pressure to actuator 28. The hydraulic oil forces actuator 28 to retract movement arm 30. The movement arm 30 is connected with flexible connection 32 which pulls lift arm 12. As the movement arm 30 is retracted, flexible connection 32 pulls the lift arm 12 around lift pivot 22. The lift arm 12 with lid connector 60, and possibly lid reinforcements 82, raises dumpster lid 64.

Limiter 46 is also mounted to lift pivot 22, as described and illustrated, and lift arm 12 engages limiter 46 at some point where the lid 64 is above the horizontal or down position. The limiter 46 thereafter rotates with the lift arm 12 around lift pivot 22 until the limiter 46 prevents further rotation by coming in contact with mounting plate 24. Thus, limiter 46 prevents over rotation of lid 64. That is, lift arm 12 will continue to rotate around lift pivot 22 and continue to open/lift lid 64 as long as the pump 66 is activated or until movement arm 30 is fully retracted or until the limiter 46 prevents further rotation.

Further, limiter 46 includes limiter return 52. Lid 64 will stay in the raised/open position as shown in FIG. 3 until valve lever 68 is placed in the lowering position. In the lowering position, hydraulic pressure is released and movement arm 30 is free to return to the extended position shown in FIG. 2. If lid 64 was raised enough for lift arm 12 to engage the limiter 46 and pressurize receiver 56 of limiter return 52, the extendable shaft 54 will be forced out of receiver 56 when pressure is released thereby forcing limiter 46 and lift arm 12 to a position where gravity will take over and return the lid 64 to the closed position shown in FIG. 2.

An important feature of the invention is that actuator 28 is loosely connected by flexible connection 32 to lift arm 12. This "loose" connection allows free motion of the lid 64 when lid 64 is in the lowered or down position shown in FIG. 2. This feature allows, therefore, a user to simply lift lid 64 by hand whenever extra assistance from the lift apparatus 10 is not needed. Thus, lift apparatus 10 does not interfere with the otherwise normal and expected operation of a dumpster 64.

The Applicant's lift apparatus and method 10 of the present invention addresses all of the aforementioned needs in the art by providing a device that mechanically assists a user in opening lids of a dumpster so that the user can use both hands to place trash in the dumpster. The lift apparatus and method 10 is of a relatively simple design and construction so that it is relatively inexpensive to manufacture and affordable to a large percentage of users. The lift apparatus and method 10 is also relatively straight forward to install, operate and maintain so that post purchase cost of ownership are reasonable. The lift apparatus and method 10 allows dumpster lids to be opened without the use of the invention and without need to disconnect or disable the invention in any fashion. Thus a user can lift the lid by hand when possible and a garbage truck can empty the dumpster at any time without any prior action of the user or garbage truck operator.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In a structure with a lid, a lift apparatus consisting of:

a. a lift arm connected with a lid connector wherein said lid connector is connected to said lid and wherein said lift arm is connected with a lift pivot on a mounting plate attached to said structure;

b. more than one separate lid reinforcing connection connecting said lid connector with said lid;

c. a movement arm connected with a flexible, non-rigid connection, wherein said flexible non-rigid connection is selected from a group comprising: chain, wire, and multiple pivotable links and wherein said flexible non-rigid connection has a length and includes a first end and a second end and is flexible along said length such that a loose connection is provided so that the lid may be lifted manually and wherein said first end of said flexible connection is connected with said lift arm at an attachment point located between said lift pivot and said connection of said lift arm with said lid connector and wherein said second end of said flexible non-rigid connection is connected with said movement arm;

d. an actuator connected with said movement arm wherein said movement arm at least partially retracts within and extends from said actuator and wherein when said actuator retracts said movement arm said flexible non-rigid connection pulls said lift arm around said lift pivot; and e. a limiter connected with said lift pivot such that movement of said lift arm beyond a predetermined amount is limited.

2. The apparatus of claim 1 wherein said lid includes a first side and a second side and said lid connector is connected to said first side and at least one lid reinforcement is connected to said second side and through said lid to said lid connector.

3. The apparatus of claim 1 wherein said lid connector is connected with said lift arm at approximately a right angle.

4. The apparatus of claim 1 wherein said actuator is powered by a hydraulic pump.

5. The apparatus of claim 4 wherein said hydraulic pump is selected from a group consisting of: manual pumps and electrical pumps.

6. The apparatus of claim 1 wherein said limiter includes a limiter return.

7. The apparatus of claim 6 wherein said limiter return is automatic.

8. In a structure with a lid, a lid lift method comprising:

a. providing a lift arm connected with a lid connector wherein said lid connector is connected to said lid and with a lift pivot on a mounting plate attached to said structure, more than one separate lid reinforcing connection connecting said lid connector with said lid, a movement arm connected with a flexible, non-rigid connection, wherein said flexible non-rigid connection is selected from a group comprising: chain, wire, and multiple pivotable links and wherein said flexible non-rigid connection has a length and includes a first end and a second end and is flexible along said length such that a loose connection is provided so that the lid may be lifted manually and wherein said first end of said flexible non-rigid connection is connected with said lift arm at an attachment point located between said lift pivot and said connection of said lift arm with said lid connector and wherein said second end of said flexible non-rigid connection is connected with said movement arm, and an actuator connected with said movement arm wherein said movement arm at least partially retracts within and extends from said actuator and wherein when said actuator retracts said movement arm said flexible connection pulls said lift arm around said lift pivot; and b. operating said actuator so as to move said lift arm and move said lid.

9. The method of claim 8 wherein said actuator is powered by a hydraulic pump and operation of the hydraulic pump moves said lift arm and moves said lid.

* * * * *